US006311910B1

(12) United States Patent
Balvanz et al.

(10) Patent No.: US 6,311,910 B1
(45) Date of Patent: Nov. 6, 2001

(54) PRODUCTION PLUS HAMMER WITH PROTECTIVE POCKET AND ROTOR ASSEMBLY

(75) Inventors: Loran R. Balvanz; Paul R. Gray, both of New Providence, IA (US)

(73) Assignee: U.S. Manufacturing, Inc., New Providence, IA (US)

( * ) Notice: Subject to any disclaimer, the term of this patent is extended or adjusted under 35 U.S.C. 154(b) by 0 days.

(21) Appl. No.: 09/436,951

(22) Filed: Nov. 9, 1999

(51) Int. Cl.[7] ..... B02C 13/02
(52) U.S. Cl. ..... 241/191; 241/195; 241/197
(58) Field of Search ..... 241/191, 195, 241/197

(56) References Cited

U.S. PATENT DOCUMENTS 3,779,470 * 12/1973 Smits ..... 241/191
4,114,817 * 9/1978 Harris ..... 241/73
4,117,984 * 10/1978 Waxelbaum et al. ..... 241/73
5,253,815 * 10/1993 Bowns et al. ..... 241/186.1
5,572,258 * 11/1996 Mischel ..... 144/208
5,704,562 1/1998 Wagstaff .
5,775,608 7/1998 Dumaine et al. .
5,941,467 * 8/1999 McArdle et al. ..... 241/5
5,967,436 * 10/1999 Balvanz ..... 241/291
6,042,035 * 3/2000 Grobler et al. ..... 241/191
6,079,649 * 6/2000 Balvanz et al. ..... 241/189.1

* cited by examiner

*Primary Examiner*—Allen Ostrager
*Assistant Examiner*—William Hong
(74) *Attorney, Agent, or Firm*—Daniel A. Rosenberg; Kent A. Herink; Davis Brown Law Firm

(57) ABSTRACT

A hammer and rotor assembly for a size reducing machine. The rotor of the assembly comprises a drive shaft for rotating the assembly. The drive shaft includes a drive end and an outboard end, wherein the drive end secures to the drive motor of the size reducing machine. End plates secure the drive end and outboard ends of the drive shaft, and a center support also secures to the drive shaft. A rotor casing is secured to the end plates and the center support. The assembly includes a plurality of hammers having a hammer body with a rotor forming portion capable of securement to the rotor casing, a tip support portion extending into the debris path from the rotor forming portion of the hammer body. The hammer body also includes a production pocket. A rotatable hammer tip with a working edge and a protected edge is secured to the tip support section of the hammer body such that the hammer tip is at least partially shielded from the debris path by the production pocket.

9 Claims, 14 Drawing Sheets

PRODUCTION PLUS HAMMER WITH PROTECTIVE POCKET AND ROTOR ASSEMBLY

BACKGROUND OF THE INVENTION

The invention relates generally to a rotor and hammer assembly for use with a size reducing machine. More specifically, the invention relates to a rotor and hammer assembly comprising a drive shaft with a rotor casing sealed by two end plates, and with a plurality of hammer secured to the rotor casing.

Impact crushers, like rotary hammermills or tub grinders, and the like, of the type contemplated herein, are widely used to size reduce objects into smaller fragments through rotation of a motor driven rotor. These devices typically include a plurality of hammers attached to the rotor. During operation the rotor spins allowing the hammers to impact, and thereby size reduce material.

Rotor assemblies used in conjunction with size reducing machine (such as tub grinders, rotary hammermills, vertical feed machines, and the like) experience a number of problems associated with the operation and maintenance of the size reducing machines. For example, the powerful and violent interaction between the rotor assembly and the matter being size reduced causes a great deal of wear on any exposed surfaces, and the interaction between the material in side the machine and the rotor and hammer assembly is difficult to control in a manner that allows for smooth and efficient operation of the machine.

Further, prior art rotor assemblies utilize a complex arrangement of parts. The parts include a plurality of hammers secured in rows substantially parallel to a drive shaft. The hammers secure to a plurality of plates, wherein each plate orients about the drive shaft. The plates also contain a number of distally located throughbores. Pins, or rods, align through the throughbores in the plates and in the hammers. Additionally, spacers align between the plates. All these parts require careful and precise alignment relative to each other. In the case of disassembly for the purposes of repair and replacement of worn or damaged parts, the wear and tear causes considerable difficulty in realigning and reassembling of the rotor parts. Moreover, the parts of the rotor assembly are usually keyed to each other, or at least to the drive shaft, this further complicates the assembly and disassembly process. For example, the replacement of a single hammer can require disassembly of the entire rotor. Given the frequency at which wear parts require replacement, replacement and repairs constitute an extremely difficult and time-consuming task that considerably reduces the operating time of the size reducing machine. In some cases removing a single damaged hammer can take in excess of five hours, due to both the rotor design and to the realignment difficulties related to the problems caused by impact of debris with the non-impact surfaces of the rotor assembly.

Prior art rotor assemblies expose a great deal of the surface area of the rotor parts to debris. The plates, the spacers, and hammers all receive considerable contact with the debris. This not only creates excessive wear, but contributes to realignment difficulties by bending and damaging the various parts caused by residual impact. Thus, after a period of operation prior art rotor assemblies become even more difficult to disassemble and reassemble. Moreover, the effects of this normal wear and tear also contributes to balancing problems, especially considering that the rotor spins at 1100 to 1900 rpm. The design of the prior art rotor assemblies also contributes to the difficulty in balancing the rotor, since the rotor assemblies require balancing from the center shaft out to the hammers. The shock load of the rotor impacts on the hammers, spacers, plates, pins, and the drive shaft. Damage to any part can effect the rotor balance.

Prior art rotor assemblies sometimes attempt to alleviate the problems of alignment by using over-sized components, or in other words deliberately introducing play into the system. The play allows extra room to move the pins in and out, for example. This, however, merely increases the opportunity for debris to wedge between the parts, which further damages the parts, and increases the need for maintenance. In some cases, due to the play in the rotor system, debris can jam the rotor to the point of preventing operation of the size reducing machine. At this point, maintenance and repair becomes extremely difficult, time consuming, and costly.

Another drawback of prior art rotors comprises residual debris impact during operation. Ideally the most efficient operation occurs when only the impact surfaces of the hammer tips encounter the debris. An open rotor assembly exposes the surface of the rotor assembly parts to debris. This not only increases the wear on these parts, but all this residual contact consumes power. Any power directed away from the hammer tips contributes to inefficient operation. The non-wear surfaces of the rotor assembly components simply do not size reduce matter with the efficiency of the hammer tips.

Conventional prior art rotor assemblies arrange the hammers in rows parallel with the axis of the center shaft (or axis of rotation). This means an entire row of hammers strike the debris simultaneously, and this takes a great deal of power. Additionally, this configuration maximizes the amount of strike force transferred to the rotor assembly, which in turn further increases the amount of wear and tear on the system. In practical terms the use of the pins, or rods, to secure the plates and hammers forces the hammers into a configuration that is parallel to the pins. Thus, prior art rotors, generally, can only configure the hammers in straight rows that align parallel to the drive shaft. Accordingly, the prior art rotor assemblies do not easily allow for varying the configuration of the hammers.

Also, prior art assemblies often experience a funneling effect that tends to channel the debris away from the drive end of the rotor assembly. This effect also contributes to inefficient operation through uneven wear across the rotor. This also increases the power required to run the assembly, since part of the assembly in doing more work than the rest of the assembly.

Based on the foregoing, those of ordinary skill in the art will realize that a need exists for a rotor assembly that provides for reduced maintenance, for more efficient operation, and for more flexible repair, replacement, and configuration of the hammers.

INCORPORATION BY REFERENCE OF RELATED DISCLOSURE

Incorporated herein by reference are the following patents and/or patents applications, which contain material of relevance to the present invention: U.S. patent application Ser. No. 09/092,198 entitled PRODUCTION PLUS HAMMER WITH PROTECTIVE POCKET filed on Jun. 5, 1998; U.S. patent application Ser. No. 09/126,164 entitled MILLENNIUM ROTOR ASSEMBLY filed on Jul. 7, 1998; U.S. patent application Ser. No. 09/185,268 entitled MILLENNIUM ROTOR ASSEMBLY filed on Nov. 3, 1998; U.S. patent application Ser. No. 09/326,209 entitled SADDLEBACK HAMMER TIP filed on Jun. 6, 1999; and U.S. patent application Ser. No. 09/362,319 entitled PRODUCTION PLUS HAMMER WITH PROTECTIVE POCKET filed on Jul. 27, 1999.

SUMMARY OF THE INVENTION

An object of the present invention comprises providing a simplified hammer and rotor assembly that extends the useful life of the wear parts and operates in a more efficient manner.

These and other objects of the present invention will become apparent to those skilled in the art upon reference to the following specification, drawings, and claims.

The present invention intends to overcome the difficulties encountered heretofore. To that end, the present invention involves a hammer and rotor assembly for a size reducing machine. The rotor of the assembly comprises a drive shaft for rotating the assembly. The assembly rotates about the drive shaft, which thereby forms an axis of rotation. The drive shaft includes a drive end and an outboard end, wherein the drive end secures to the drive motor of the size reducing machine. End plates secure the drive end and outboard ends of the drive shaft. A rotor casing is secured to the end plates. The assembly includes a plurality of hammers secured to the rotor casing.

DETAILED DESCRIPTION OF THE INVENTION

Figure 1B:
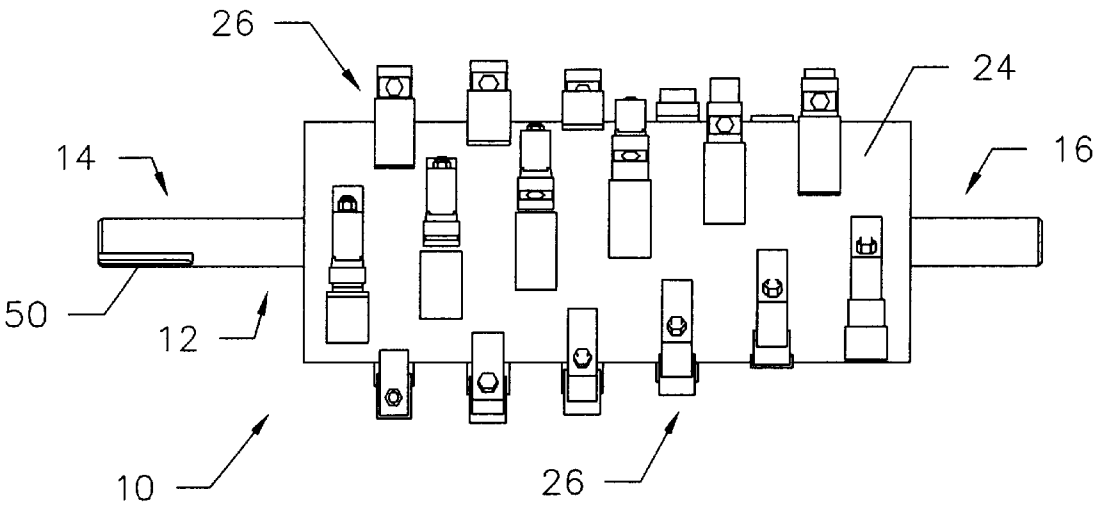
FIG. 1*b* is a side view of the hammer and rotor assembly.
Figure 1A:
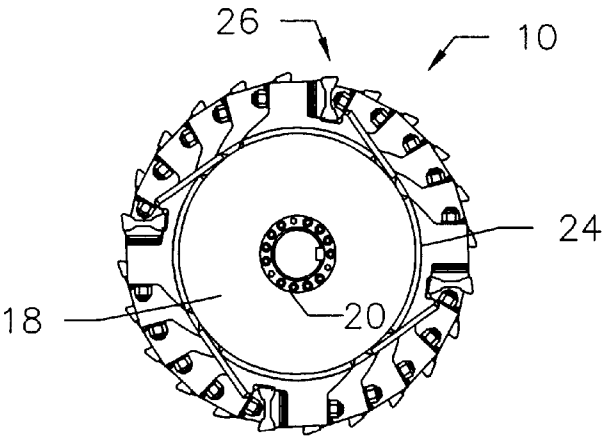
FIG. 1*a* is an end view of a hammer and rotor assembly.
Figure 2B:
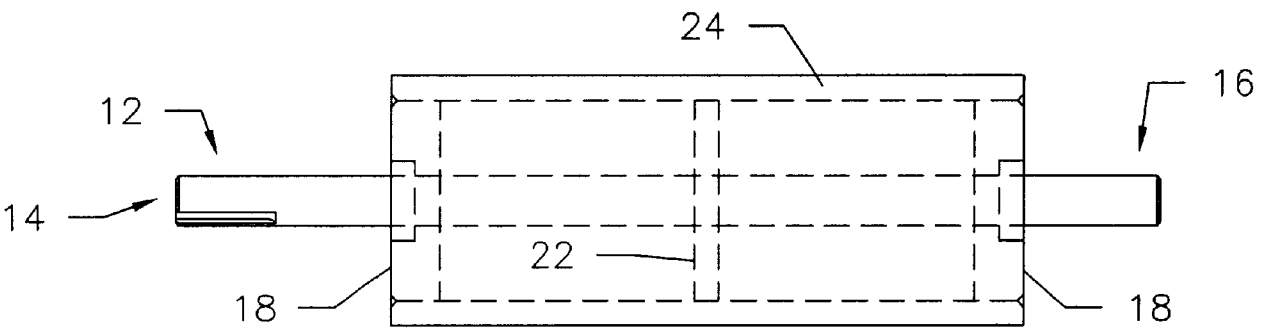
FIG. 2*b* is a side view of the hammer and rotor assembly.
Figure 2A:
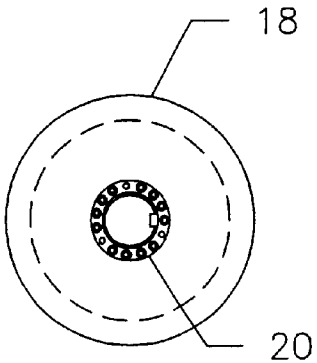
FIG. 2*a* is an end view of an end plate of the hammer and rotor assembly.

In the drawings, FIG. 1*a* shows an end view of a hammer assembly 10. FIG. 1*b* shows a side view of the same hammer assembly 10. The hammer assembly 10 comprises a drive shaft 12 with a drive end 14 and an outboard end 16. The drive end 14 of the drive shaft 12 contains grooves 50 for attachment to a drive motor (not shown) or a size reducing machine (partially shown in FIG. 3). The drive motor rotates the drive shaft 12 at high speeds during operation of the size reducing machine. The rotor assembly 10 also includes two identical end plates 18, and a center support 22 (see FIGS. 2*a–b*). The end plates 18 and center support 22 secure to the drive shaft 12. The end plates 18 both seal the rotor assembly 10 and provide interior support for the assembly 10. The center support 22 provides center support for the rotor assembly 10. A rotor casing 24 surrounds and secures to the end plates 18 and center support 22. The combination of the drive shaft 12, end plates 18, center support 22, and rotor casing 24 form an integrated self-supporting sealed unit that greatly simplifies past designs. The design seals the interior of the rotor assembly 10 to prevent the problems associated with debris damaging and wedging into the components of prior art assemblies. These problems result in both an increased need to repair the interior components of prior art rotor assemblies, but also increases in the difficulty and time required to make those repairs. The rotor assembly 10 of the present invention substantially eliminates these difficulties.

In the preferred embodiment of the present invention the end plates 18 are 4" thick. The end plates secure to the rotor casing 24 with weldments and use a commercially available locking mechanism 20 to secure to the drive shaft 12. The lock 20 is provided by US Tsubaki and utilizes contracting and expanding rings to create a compression fitting about the drive shaft 12. The center support 22 secures to the drive shaft 12 and the rotor casing 24 through weldments. The center support 22 is 2" thick. The rotor casing 24 is also 2" thick. The drive shaft 12 is comprised of a heated chrome-molly alloy (#4140). While the end plated 18, center support 22, and rotor casing 24 are comprised of a mild steel material. The hammers 26 are comprised of a steel alloy of higher tensile strength (#1144). Those of ordinary skill in the art will realize that the materials and the dimensions can change without departing from the scope of the intended invention.

Figure 3:
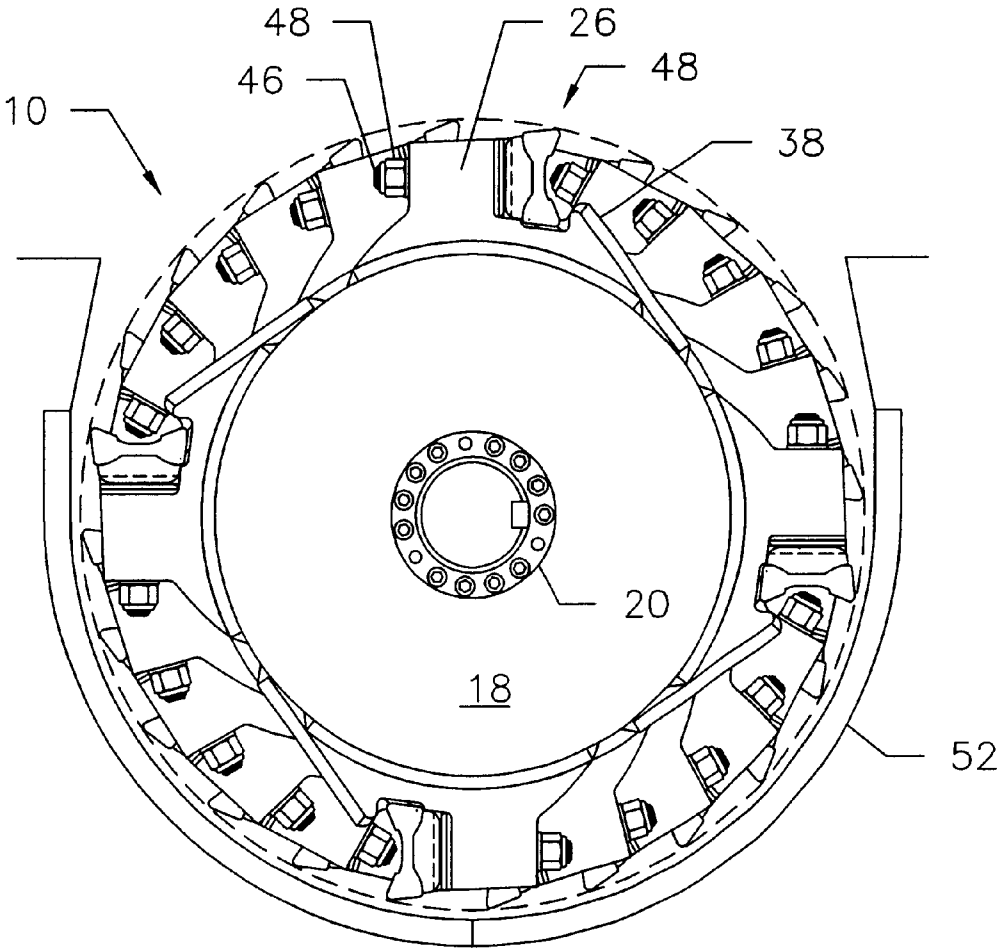
FIG. 3 is an end view of the hammer and rotor assembly and screen.
Figure 4A:
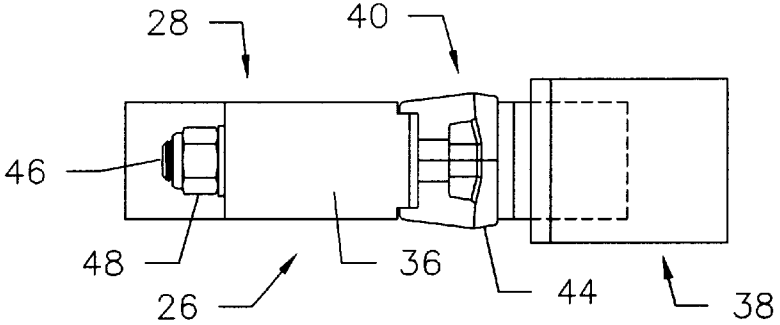
FIG. 4*a* is a top view of the hammer.
Figure 4B:
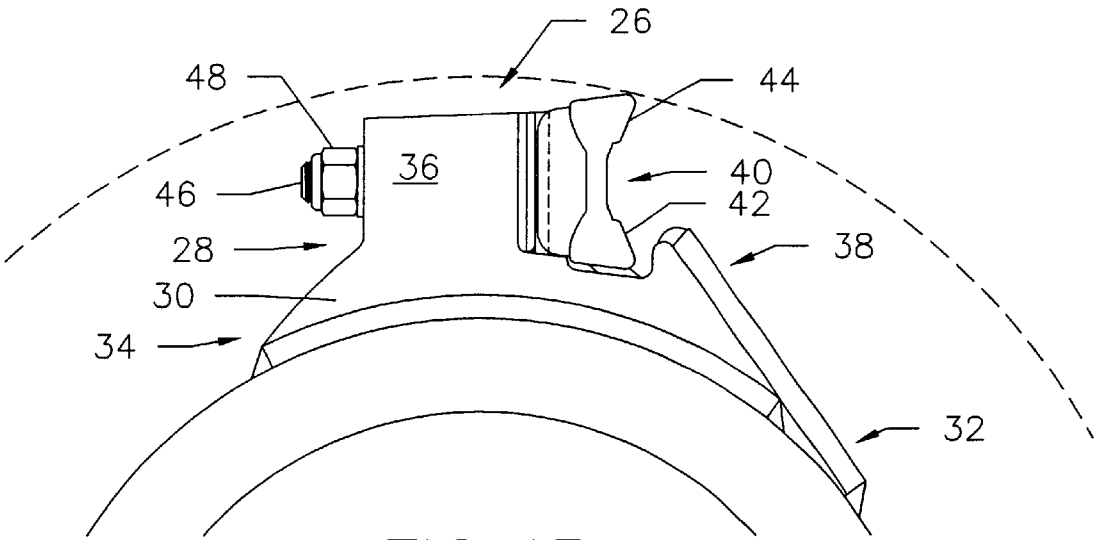
FIG. 4*b* is a side view of the hammer and casing.

FIG. 1*b,* FIG. 3, and in particular FIGS. 4*a–b* show that the rotor assembly 10 further comprises a plurality of hammers 26. The hammers 26 comprise a hammer body 28, which further comprises a rotor forming portion 30 and a tip support portion 36. Also, the rotor forming portion 30 of the hammer body 28 further comprises a leading edge 32 and a trailing edge 34. The leading edge 32 indicates the direction of rotation of the rotor assembly 10, in that the trailing edge 34 follows the leading edge 32. In the preferred embodiment of the invention the hammers 26 secure to the rotor casing 24 through weldments. Although, those of ordinary skill in the art will appreciate the fact that the hammers 26 can secure to the rotor casing 24 through other methods without departing from the scope of the invention.

The tip support section 36 of the hammer body 28 receives a rotateable hammer tip 40. The hammer tip is of the type disclosed in U.S. patent application Ser. No. 09/326,209, in that it includes the Saddle-Back design revealed therein. The hammer tip 40 secures to the tip support section 36 of the hammer body 28 through one or more threaded bolts 46 and nuts 48. The hammer tip 40 includes a working edge 44 and a protected edge 42. The hammer tip 40 is rotatable about an axis substantially tangent to the axis of rotation. The working edge 44 of the hammer tip 40 extends further into the debris path than any other portion of the rotor assembly 10. In this manner, the working edge 44 travels faster and directs the most force toward the debris. Maximizing impact to the working edge 44 of the hammer tip 40 increases the efficiency of the size reducing operation.

To achieve this efficiency, the rotor forming portion 30 of the hammer body 28 differs substantially from the prior art in that the leading edge 32 of the rotor forming portion 30 contains a production pocket 38. The production pocket 38 extends upward from the leading edge 32 into the debris path a distance great enough to protect a portion of the rotatable hammer tip 40. In particular, only the working edge 44 of the rotatable hammer tip 40 is fully exposed to the debris path. The protected edge 42 of the rotatable hammer tip 40 rests behind the production pocket 38, and therefore is out of the debris path. This ensures that the more powerful working edge 44 will strike the debris. Once the working edge 44 is sufficiently worn, the hammer tip is rotated exposing the protected edge 42 to the debris path. Consequently, the production pocket 38 prevents unnecessary wear to the protected edge 42 thereby extending the life of the protected edge 42. Furthermore, the production pocket 38 also deflects debris thereby reducing the contact of debris with the heads of the securement bolts 46.

A further advantage of the production pocket 38 comes from the ability of the production pocket 38 to effect the flow of debris. Because the production pocket 38 extends into the debris path it not only protects the non-working or protected edge 42 of the hammer tip 40, it directs debris toward the working edge 44 of the hammer tip 40. Debris that encounters the production pocket 38 is directed upwards toward the working edge 44. Of course, the further from the center of the rotor assembly 10 that the debris impacts the hammer tip 40 the greater the force of impact. Thus, focusing the debris toward the working edge 44 of the hammer tip 40 enhances the efficiency of the size reducing operation. In a similar manner, the production pocket 38 will direct debris toward a screen 52 and out of the machine (see FIG. 3). The screen 52 contains a suitable sized mesh that effectively traps larger debris for continued impact with the hammer tip 40, while allowing smaller debris to pass through and out of the size reducing machine. Directing debris toward the screen 52 improves the efficiency of operation by reducing operating time, and by reducing unnecessary wear on the working edge 44 of the hammer tip 40 by preventing impact with material already sufficiently size reduced.

Additionally, FIG. 3*a* shows that the width of the production pocket 38 is substantially equal to, or greater then, a width of the protected edge 42 of the rotatable hammer tip 40. This allows the production pocket 38 to better deflect debris from the protected edge 42 of the rotatable hammer tip 40. In order to protect the production pocket 38 upon contact with the debris, the production pocket 38 is coated with wear resistant coating similar to that provided for the hammer tip 40. In the preferred embodiment of the invention the wear resistant coating comprises tungsten carbide.

Configured in the manner shown, the hammer 26 of the rotor assembly 10 substantially eliminates wear and tear on the protected edge 42 of the rotatable hammer tip 40 through adapting the hammer body 28 to include the production pocket 38. The production pocket 38 by deflecting debris away from the protected edge 42 of the rotatable hammer tip 40, and away from securement bolts 46 substantially increases the useful life of the rotatable hammer tip 40. By increasing the useful life of the rotatable hammer tip 40 the production pocket 38 also reduces the cost, and down time associated with the operation of size reducing machines. Furthermore, by focusing the debris toward the working edge 44 of the hammer tip 40 the production pocket 38 increases the efficiency of operation.

Shown best in FIG. 1*b,* the hammers 26 are arranged in a plurality of staggered rows. This allows each hammer 26 to individually strike the debris being size reduced. Arranging the hammers 26 in unstaggered rows, while acceptable, requires a greater amount power, thereby transferring a greater shock load through the rotor assembly 10. Of course, the greater the shock load the greater the chances of damage to the rotor assembly 10. It is anticipated that other arrangement and configurations of staggers to the rows of hammers 26 could be used to some advantage. For example, the transverse stagger could be v-shaped, or a saw tooth pattern, or the like.

Figure 5:
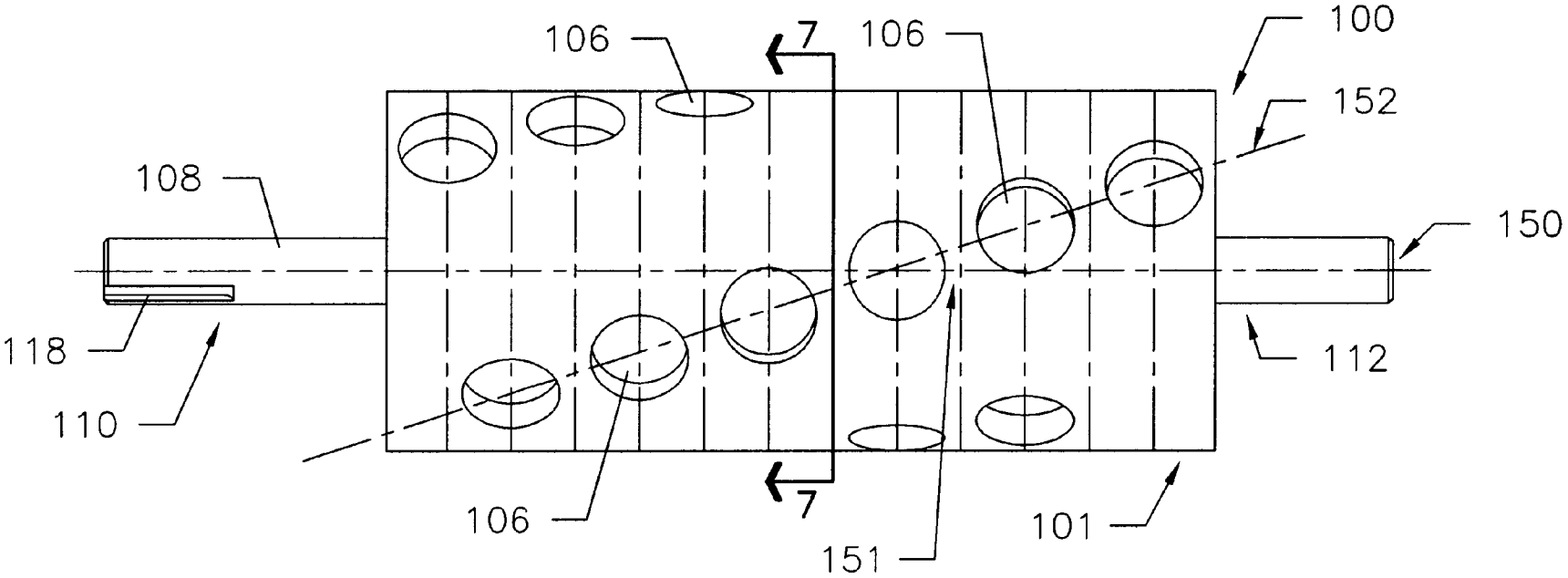
FIG. 5 is a side view of an alternative rotor and hammer assembly.

FIGS. 5–13 show an alternative embodiment of the present invention, substantially similar to assembly 10 described above except in the following regards. In particular, FIG. 5 shows a rotor and hammer assembly 100 with a drive shaft 108 (see FIG. 8). The drive shaft 108 has a drive end 110 for securement to the drive motor of a size reducing machine, and an outboard end 112 opposite to the drive end 110. Additionally, the assembly 100 includes a rotor casing 101 with a plurality of socket holes 106 for insertion of a socket designed to receive a hammer. The drive shaft 110 defines an axis of rotation 150, about which the rotor and hammer assembly 100 rotates. Viewing the assembly 100 in the manner depicted in FIG. 7*a,* the assembly 100 would rotate clockwise.

Figure 6:
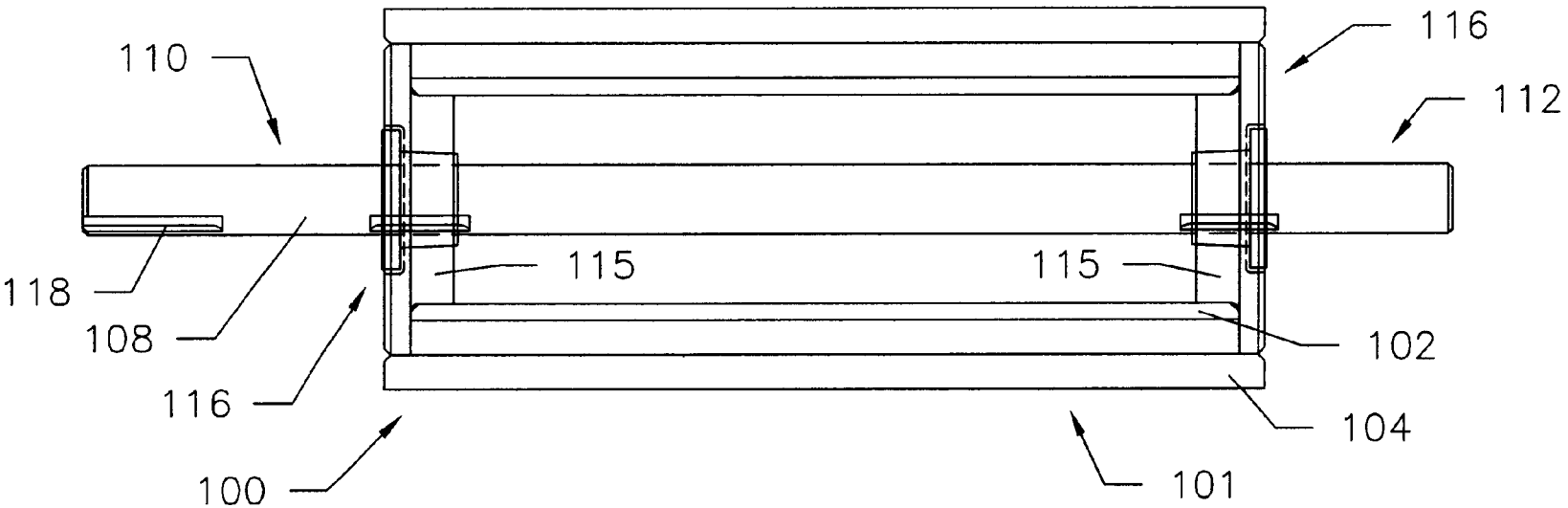
FIG. 6 is a side cross-sectional view of the assembly of FIG. 5.

FIG. 6 shows that the rotor casing 101 consists of an inner casing 102 and an outer casing 104, with a gap therebetween. The outer casing 104 is 22" in outer diameter with a 2" thick wall, while the inner casing 102 is 14" in outer diameter with an 1" thick wall. The assembly 100 also includes two endplates 116 that enclose the casing 101 and the drive shaft 108. Shown best in FIG. 6, the outer casing 104 is welded to the outer most portion of the endplates 116, while the inner casing 102 is welded to a reduced diameter inner hub 115 of the endplates 116. Accordingly, the inner casing 102 is beveled at the ends to securely affix to the transition between the hub 115 and an endcap 120 of the endplate 116.

In the preferred embodiment of the present invention the drive shaft 108 is approximately 80" in length and 4" in diameter, and the distance between the outside edges of the endplates 116 is approximately 51". The drive shaft 108 is offset such that the drive end extends approximately 17" from the endplate 116 located on the drive end 110 of the assembly 100. This is designed to accommodate attachment to the drive motor through the slotted drive shaft motor key 118.

The socket holes 106 are arranged in four evenly spaced and offset rows about the rotor casing 101. With reference to the axis of rotation 150, each of the rows of socket holes 106 forms a socket axis 152. Thus, the axis of rotation 150 and the socket axis 152 intersect to form an angle of offset 151. In the preferred embodiment of the present invention the angle of offset 151 between the axis of rotation 150 and the socket axis 152 equals 15 degrees. Additionally, the socket holes 106 in any given row angle such that the socket holes 106 at the outboard end 112 rise above the socket holes 106 at the drive end 110. In this manner, during operation the assembly 100 rotates such that the socket holes 106 closest to the outboard end 112 contact debris prior to and ahead of the socket holes 106 closest to the drive end 110. It is believed that this arrangement counteracts the conventional problem experienced by rotors with no angle of offset 151 between the socket axis 152 and the axis of rotation 150, whereby the hammers closest to the drive end 110 do more work and experience more wear than the hammers on the outboard end 112 of the assembly 100. In the arrangement previously described, the hammers affix to the socket holes 106 closest to the outboard end 112 contact the debris first and channel the debris uniformly across the rows of hammers. This promotes not only even wear of the wear parts, but greatly enhances the efficiency of operation by ensuring that all the hammers do equal work.

The socket holes 106 are spaced apart by approximately 7.954" from center to center. The rows socket holes 106 are generally evenly spaced across the assembly 100, with adjacent rows staggered. In particular, the center of the socket hole 106 closest to the drive end 110 is 3.752" from the edge of the outer casing 104, with the remaining socket holes 106 in that row evenly spaced as just described. The immediately adjacent rows of socket holes 106 are offset from the edge of the outer casing 104 by an additional 3.977". This means that around the outside of the outer casing of the four socket holes closest to the drive end 110, two of the socket holes 106 will be offset 3.752" from the edge of the outer casing 104 and of the other two socket holes 106 will be offset 7.729". This pattern produces four rows of socket holes 106. Adjacent rows are staggered, while rows on the opposite ends of the assembly 100 are identically positioned.

Figure 7B:
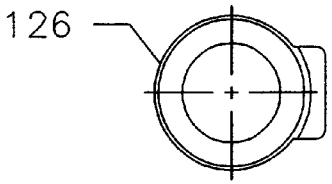
FIG. 7*b* is a top view of a socket of the assembly of FIG. 7*a*.
Figure 7A:
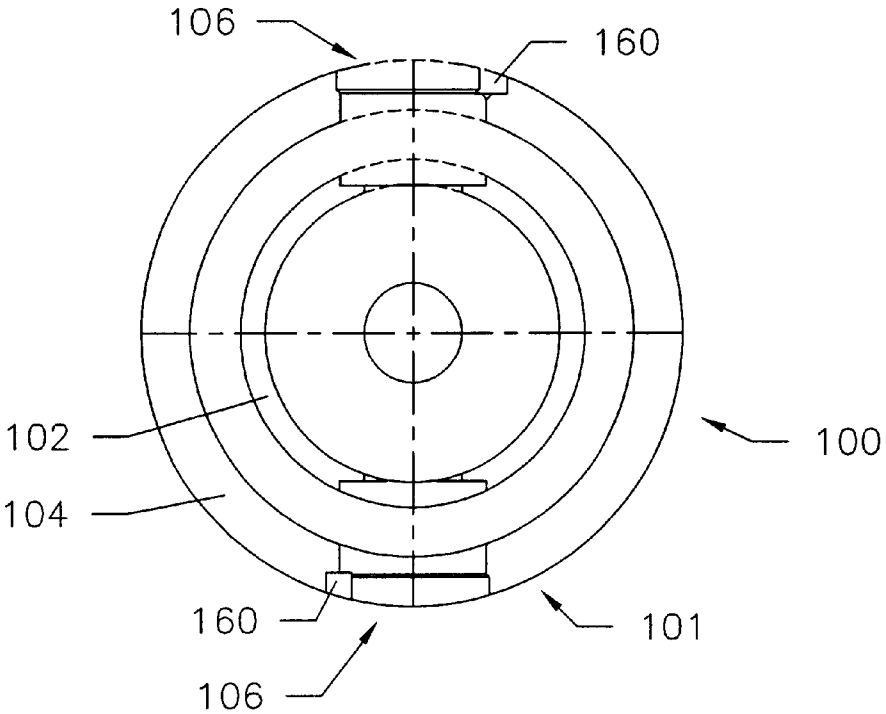
FIG. 7*a* is a cross-sectional view of the assembly of FIG. 5 taken along the line 7—7 shown in FIG. 5.
Figure 8:
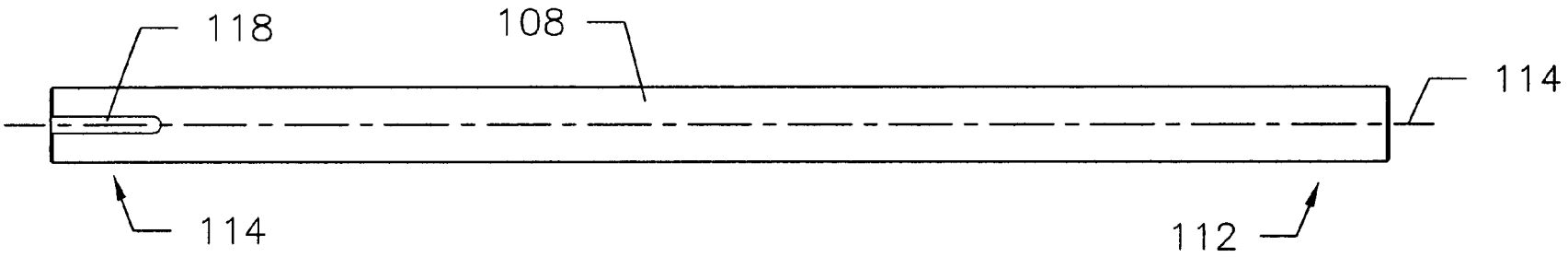
FIG. 8 is a side view of the drive shaft of the assembly of FIG. 5.

FIG. 7*a* shows a side view of cross-section of the assembly 100. FIG. 7*a* shows the relationship between the rotor casing, including the outer casing 104 and the inner casing 102, and the sockets 126 (shown in FIG. 7*b*). The sockets 126 fit into the socket holes 106. The socket holes 106 are designed to receive the socket 126 which is approximately 6¼" in outer diameter and 4" in inner diameter at the top end of the socket 126. The socket 126 narrows slightly to just below a pocket 160. The pocket 160 represents a cutout portion of the outer casing 104 designed to shield the lower portion of the tip of the hammer (explained in detail hereinbelow).

Figure 9B:
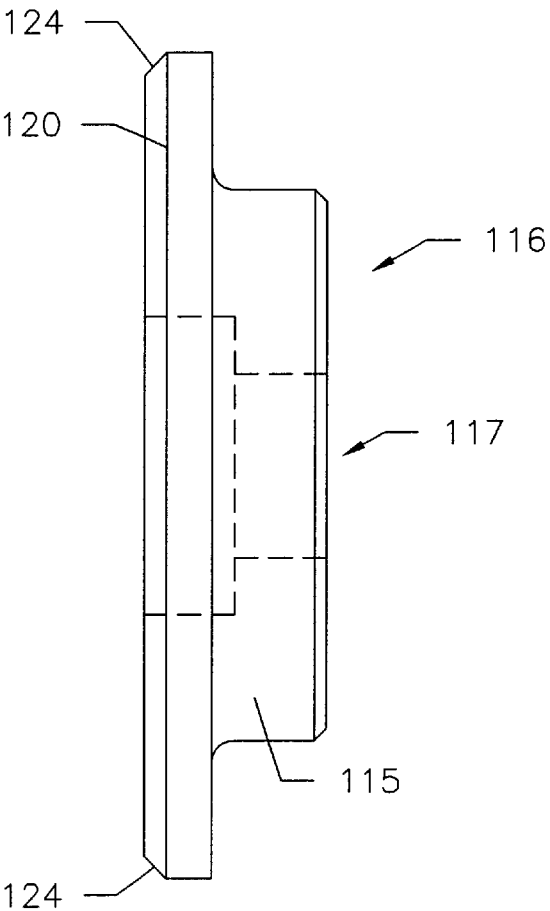
FIG. 9*b* is a side view of the end plate of the assembly of FIG. 5.
Figure 9A:
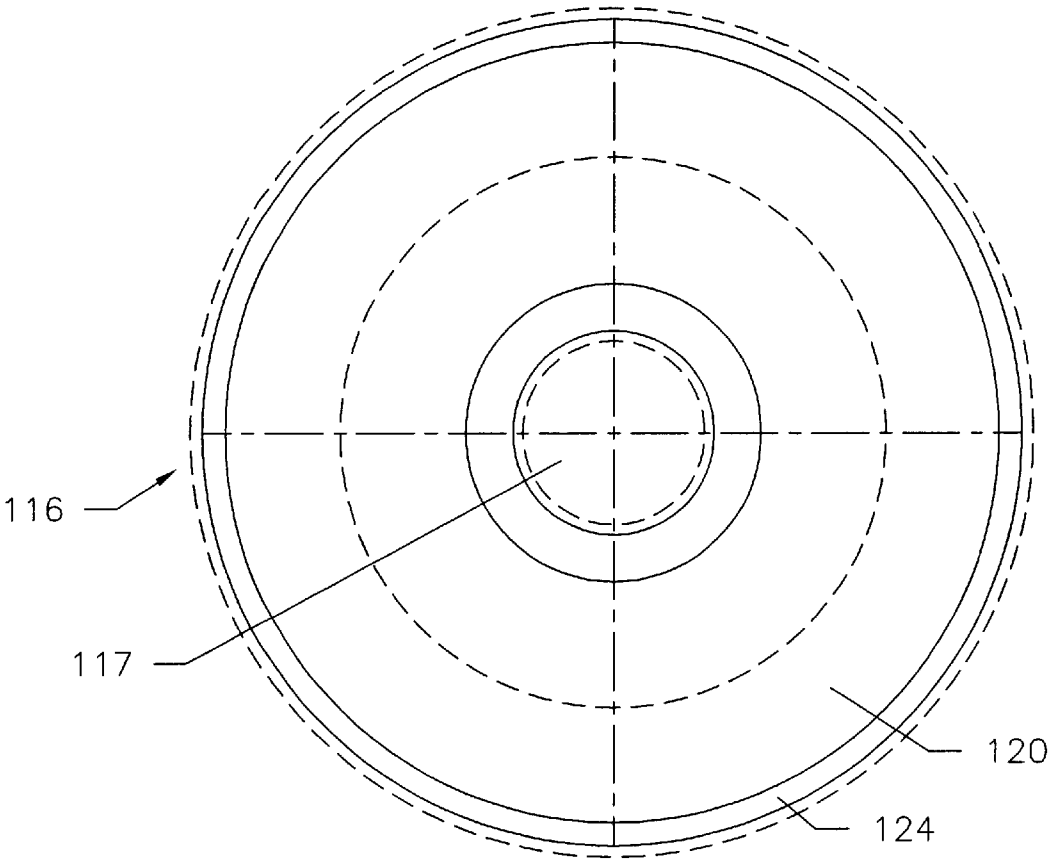
FIG. 9*a* is an end view of the end plate of the assembly of FIG. 5.

FIGS. 9*a–b* show the endplate 116, FIG. 7*a* and 7*b* show that the outer casing 104 supports the upper portion of the sockets 126, while the inner casing 102 supports the lower portion of the socket 126, with a gap in the casing 101 there between, which includes a hub 115 located on the inside of the endplate 116, and an end cap 120 along the outer edge of the endplate 116. The end cap 120 includes a beveled or angled offset edges 124 designed to conform to the outer casing 104. The endplate 116 includes a drive shaft hole 117 that allows for insertion of the drive shaft 108. The drive shaft hole 117 is approximately 6.5" at its widest point adjacent to the end cap 120 and narrows to approximately 4.5" as it passes through the hub 115. A locking mechanism like that described above, attaches to the enlarged portion of the drive shaft hole 117 to further secure the assembly 100. The endplate 116 is approximately 4" in width with the hub 115 measuring 2½" in width. The endplate 116 is of a sufficient diameter to fully enclose the casing 101.

Figure 10C:
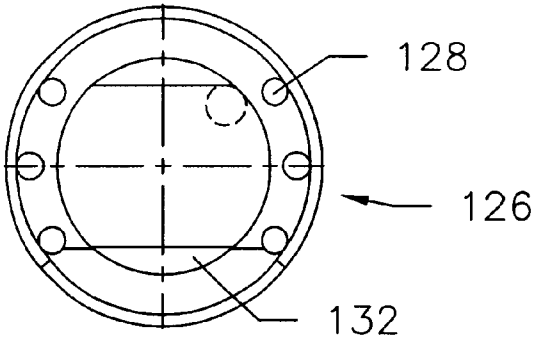
FIG. 10*c* is a top view of the socket of FIG. 10*a,* rotated 90°.
Figure 10D:
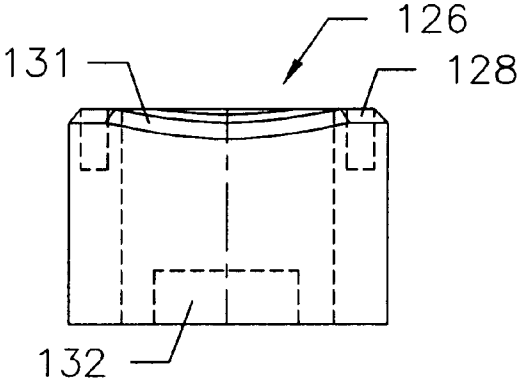
FIG. 10*d* is a front view of the socket of FIG. 10*b,* rotated 90°.
Figure 10A:
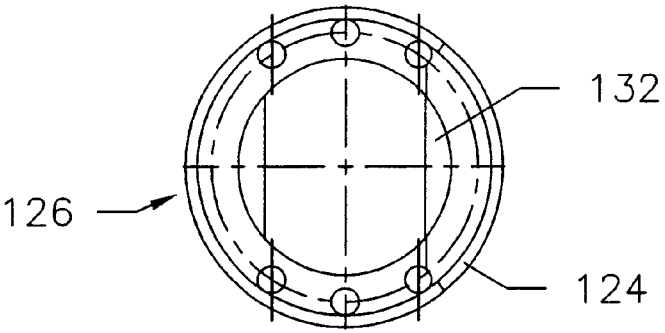
FIG. 10*a* is a top view of a socket of the assembly of FIG. 5.
Figure 10B:
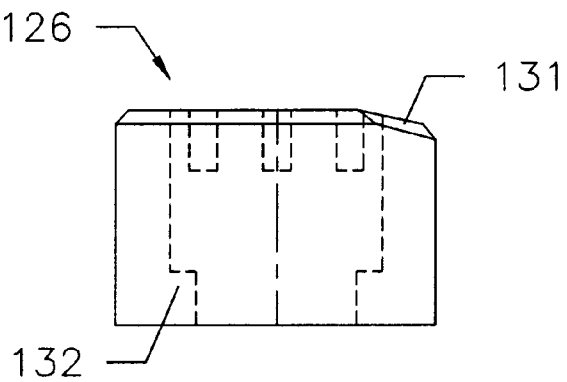
FIG. 10*b* is a side view of the socket of FIG. 10*a*.

FIGS. 10*a–d* show various views of the socket 126. The socket 126 includes threaded holes 128 to allow for screws or threaded bolts to allow the sockets 126 to releasably secure to the hammers 134. The outer diameter of the socket 126 measures approximately 5.94", with the inner diameter measuring approximately 4.006" in the preferred embodiment. Further, FIGS. 10*b* and 10*d* show that the socket 126 includes a recess 132 for capture of the hammers. Preferably, the sockets 126 measure approximately 4" in height with the recess occupying the lower 1" of the socket 126. The recess 132 consists of a narrowing of the diameter of the opening of the socket 126 to allow for additional releasable securement of the hammers (explained in detail hereinbelow). The sockets also include a beveled edge 131, shown best in FIGS. 10*b* and 10*d*. The beveled edge 131 works in cooperation with the pocket 160 (explained in detail hereinbelow). The sockets 126 secure to the rotor casing 101 through weldments.

FIGS. 11, 12, and 13 show various configurations of hammers 134 for insertion into the sockets 126 shown in 10*a–d*. The hammers 134 differ in size and in the type of tip that they receive, but otherwise secure to the sockets 126 in an identical manner. In particular, FIGS. 11*a–f* show a hammer 134 from a variety of perspectives. The hammer 134 includes an upper body 136 and a lower body 138. The upper body 136 of the hammer 134 includes means for securing a hammer tip to the upper body portion 136. FIGS. 11*d*, and 11*e* show bolt holes 145 for securing a hammer tip to the upper body 136 of the hammer 134. FIGS. 12–13 show a hammer 134 with a single bolt hole 145 for attaching a single bolt hammer tip.

FIGS. 11*a–f*, show that the hammer 134 contains recessed holes 135 that correspond in mating alignment with the socket holes 128 of the sockets 126. In this manner, flush mounted screws releasably secure the hammer 134 within the socket 126. Further securement is provided by interlocking the lower body 138 of the hammer 134 within the socket 126. In this regard, the lower body 138 of the hammer 134 includes a first lower body section 140, a second lower body section 142, and a third lower body section 144. The lower body sections 140, 142, 144 form a recessed ledge 146 (see FIG. 11*b*) for capture by the inner recess 132 of the socket 126.

Figure 11E:
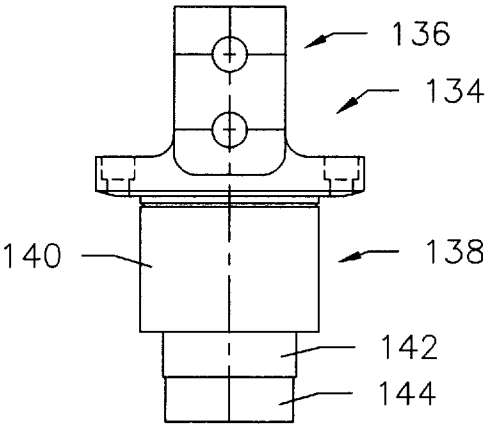
FIG. 11*e* is a back view of the hammer of FIG. 11*d,* rotated 180°.
Figure 11F:
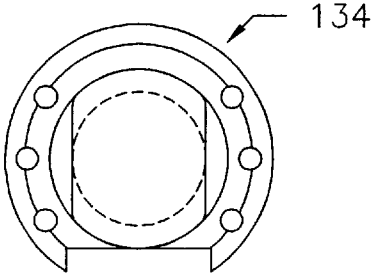
FIG. 11*f* is a bottom view of the hammer of FIG. 11*a*.
Figure 11C:
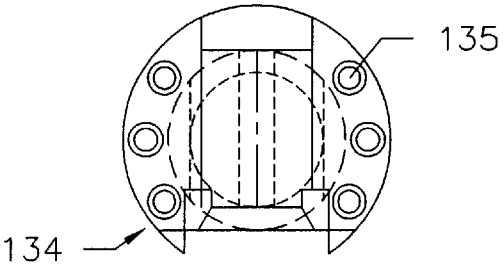
FIG. 11*c* is a top view of the hammer of FIG. 11*a,* rotated 90°.
Figure 11D:
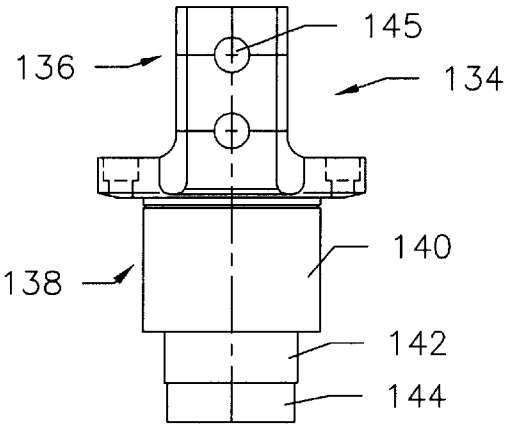
FIG. 11*d* is a front view of the hammer of FIG. 11*b,* rotated 90°.
Figure 11A:
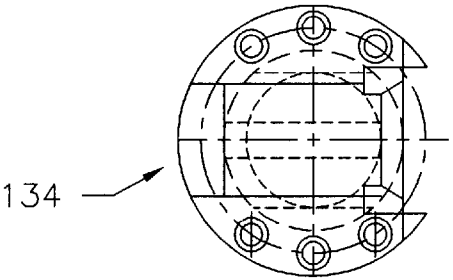
FIG. 11*a* is a top view of a hammer of the assembly of FIG. 5.
Figure 11B:
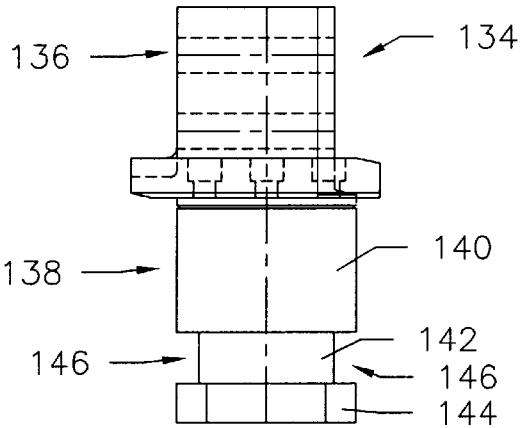
FIG. 11*b* is a side view of the hammer of FIG. 11*a*.
Figure 12C:
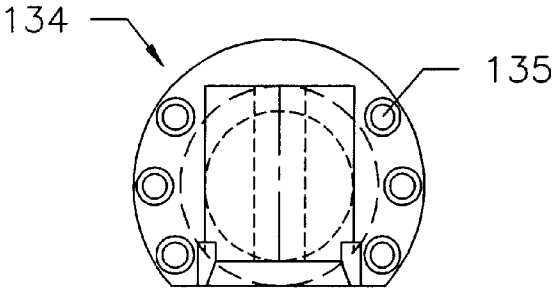
FIG. 12*c* is a top view of the hammer of FIG. 12*a,* rotated 90°.
Figure 12A:
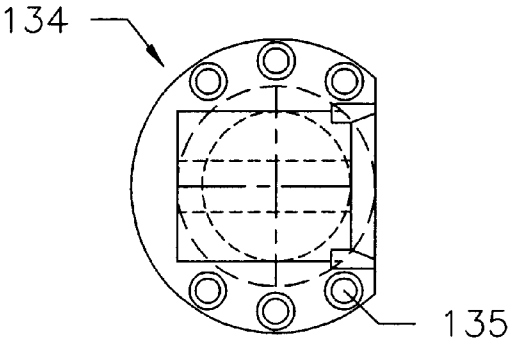
FIG. 12*a* is a top view of a hammer.
Figure 12D:
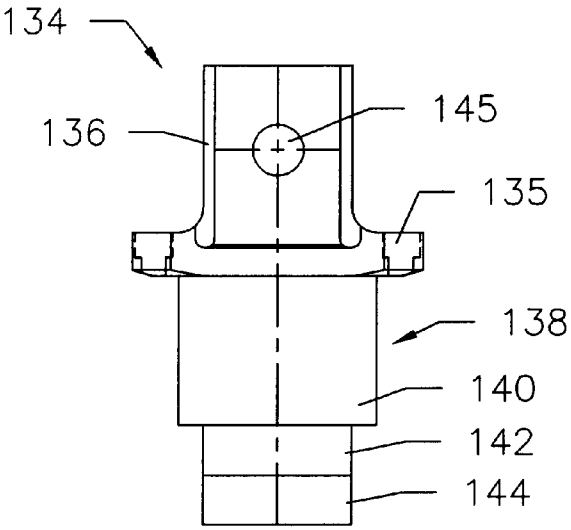
FIG. 12*d* is a front view of the hammer of FIG. 12*b,* rotated 90°.
Figure 12B:
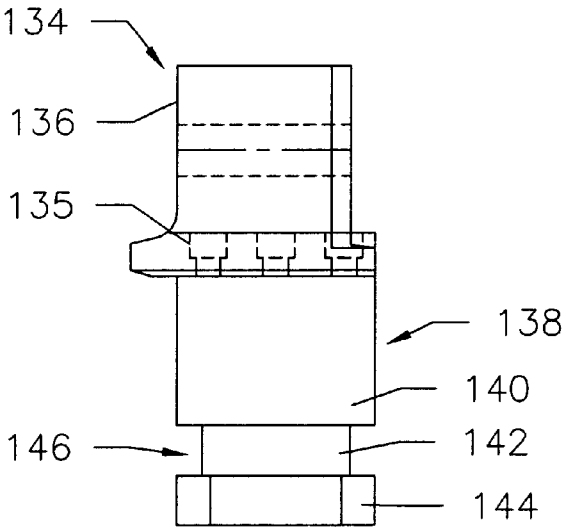
FIG. 12*b* is a side view of the hammer of FIG. 12*a*.
Figure 13A:
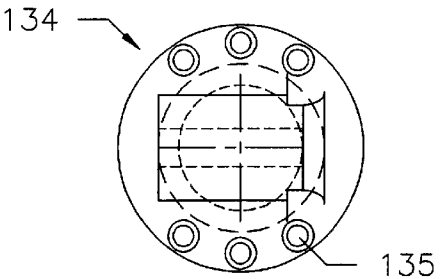
FIG. 13*a* is a top view of a hammer.
Figure 13C:
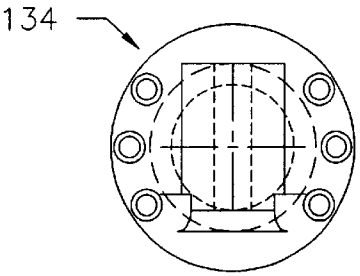
FIG. 13*c* is a top view of the hammer of FIG. 13*a,* rotated 90°.
Figure 13B:
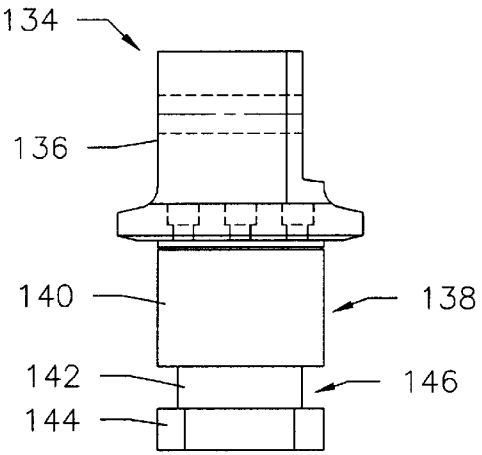
FIG. 13*b* is a side view of the hammer of FIG. 13*a*.
Figure 13D:
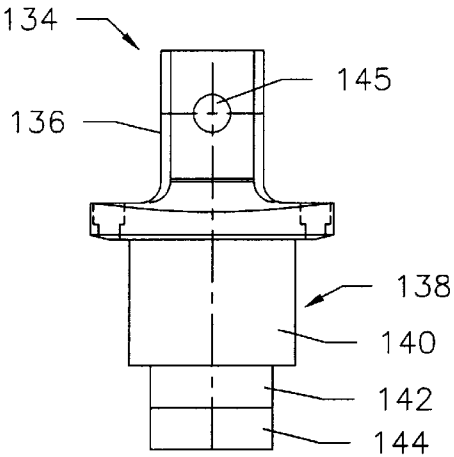
FIG. 13*d* is a front view of the hammer of FIG. 13*b,* rotated 90°.

In particular, in the orientation shown in FIG. 11*b*, the third lower body section 144 has a width of approximately 4", while in the orientation shown in FIG. 11*d* the third lower body section 144 has a width of approximately 2.99". Thus, inserting the hammer 134 in the orientation shown in FIG. 11*d* into the socket 126 in the orientation shown in FIG. 10*b* will allow the third lower body section 144 to pass by the inner recess 132 of the socket 126. The inner recess 132 of the socket 126 is constructed to have a diameter slightly larger than the width of the third lower body section 144 and the second lower body section 142 as depicted in FIG. 11*d*. In other words, the inner recess 132 of the socket 126 creates a narrow opening in the socket of approximately 3". This is a sufficient opening to allow the third lower body section 144 to pass freely through the opening in the socket 126 when aligned in the orientations shown in FIG. 11*d* and FIG. 10*b*. After insertion, rotating the hammer 134 ninety degrees will create an inner lock that will prevent removal of the hammer 134 from within the socket 126. By rotating the hammer 134 ninety degrees, the hammer 134 will appear in the manner shown in FIG. 11*b*, while the socket 126 will remain in the same orientation shown in FIG. 10*d*. In other words, rotated in this manner the third lower body section 144 has a width of approximately 4", while the recess 132 creates an opening of approximately 3" in the socket 126. This engages the recessed ledge 146 and the inner recess 132 to prevents vertical movement of the hammer 134. Additionally, rotating the hammer 134 into this position aligns the holes 135 in the hammer 134 with the holes 128 in the socket 126 allowing for insertion of screws to further secure the hammer 134 to the socket 126.

In the preferred embodiment of the invention, the hammer 134 measures 9.226" in height. The upper hammer body measures 4.226" from the top to beginning of the first lower body section 140. The lower hammer body 138 is 5" in height, with the first lower body section 140 measuring 2.995", the second lower body section 142 measuring 1.01", and the third lower body section 144 measuring 0.995". The hammers 134 depicted in FIGS. 12*a–d* and FIGS. 13*a–d* differ only in the size and shape of the upper hammer body 136. The hammers 134 shown in FIG. 12 and FIG. 13 receive different size tips, but otherwise function in an identical manner than the hammers 134 shown previously.

Figure 14B:
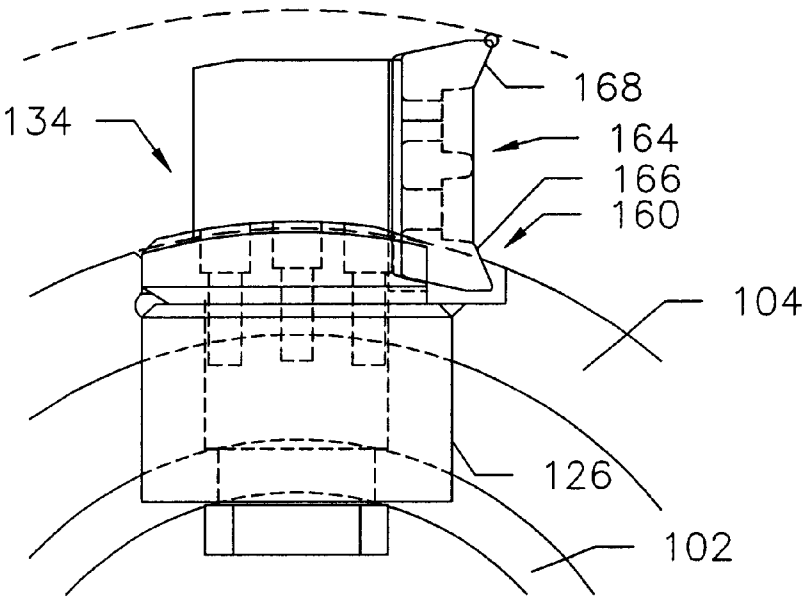
FIG. 14*b* is a cross-sectional view of the hammer and rotor assembly with the hammer of FIG. 14*a*.
Figure 14A:
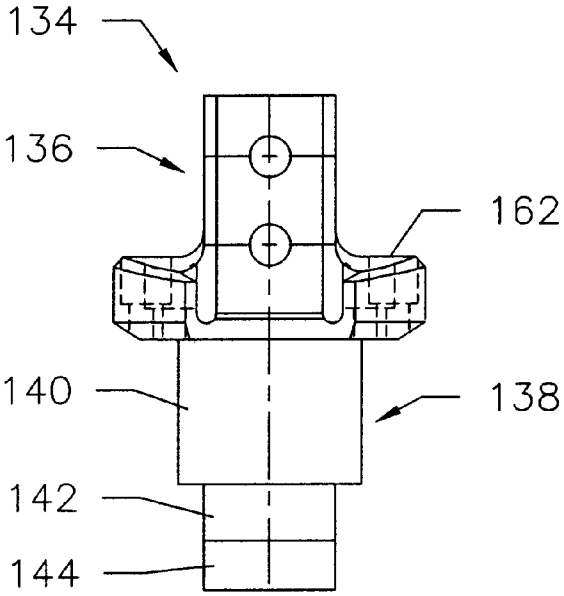
FIG. 14*a* is a front view of a hammer.

FIG. 14*a* shows a hammer 134, essentially identical to the hammers described previously, with the additional feature of a bevel in the ring 162. The bevel appears on either side of the front of the upper hammer body 136. This allows the hammer 134 to better seat within the socket 126 (see FIG. 14*b*). In particular, FIG. 14*b* shows that the socket area includes the pocket 160. The pocket 160 provides a recess to protect a lower tip 166 of a hammer tip 164. This ensures that a working tip 168 does the work of size reducing, and protecting the lower tip 166 with the pocket 160 provides the advantages of the production pocket 38 described hereinabove.

The assembly 100 provides a secure means to attach the hammers 134 in a manner that allows for easy replacement of the hammers 134 on an individual basis. This eliminates the problems associated with prior art assemblies, where removing the hammer requires disassembling the entire rotor assembly. The rotor casing 101 provides support for the sockets 126, and for the assembly 100 in general, in a way that avoids exposing the assembly 100 to undue wear and tear experienced by prior art assemblies. The assembly 100 eliminates all of the excess parts that create the alignment problems of past assemblies. This reduces the need for repair and maintenance, and allows for more efficient operation. Additionally, the retains all of the advantages associated with the assembly 10 described hereinabove.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing form the scope of the invention.

What is claimed is:

1. A rotor and hammer assembly for use with a size reducing machine having a drive motor, said assembly comprising:

a) a drive shaft for rotating the assembly having a drive end capable of securement to the drive motor of the size reducing machine, and an outboard end opposite said drive end;

b) wherein said drive shaft forms an axis of rotation;

c) end plates secured to said drive end and outboard end of said drive shaft, wherein said end plate includes a inner hub;

d) an outer rotor casing secured to said end plates forming an enclosure with a substantially hollow interior, wherein said outer rotor casing includes a plurality of socket holes;

e) an inner rotor casing secured to said inner hub of said end plates forming an enclosure within said substantially hollow interior formed by said outer rotor casing, wherein said inner rotor casing includes a plurality of socket recesses aligned with said socket holes of said outer rotor casing;

f) a plurality of sockets secured to said socket holes of said outer rotor casing and to said socket recesses of said inner rotor casing; and g) a plurality of hammers secured to said sockets.

2. The invention in accordance with claim 1 wherein said hammers are arranged in at least one row wherein said row of hammers and said axis of rotation form an angle of offset.

3. The invention in accordance with claim 2 wherein said hammers closest to said outboard are offset in the direction of rotation relative to said hammers closest to said drive end.

4. The invention in accordance with claim 2 wherein said angle of offset is approximately 15 degrees.

5. The invention in accordance with claim 2 further comprising four rows of hammers.

6. The invention in accordance with claim 5 wherein said rows of hammers are evenly spaced about said axis of rotation.

7. The invention in accordance with claim 1 wherein said hammers are releasably secured to said sockets by engaging a recessed ledge of said hammers with an inner recess of said sockets.

8. The invention in accordance with claim 7 wherein said hammers are releasably secured to said sockets through screws.

9. The invention in accordance with claim 1 further comprising a hammer tip secured to each of said hammers and a pocket in said rotor casing adjacent to said hammers, said hammer tip having an upper edge and a lower edge such that said lower tip is recessed within said pocket.

* * * * *